US007192895B2

(12) United States Patent
Ito

(10) Patent No.: US 7,192,895 B2
(45) Date of Patent: Mar. 20, 2007

(54) PAPERMAKING FELT

(75) Inventor: Yoshiaki Ito, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 61 days.

(21) Appl. No.: 10/835,047

(22) Filed: Apr. 29, 2004

(65) Prior Publication Data

US 2004/0266298 A1 Dec. 30, 2004

(30) Foreign Application Priority Data

Jun. 30, 2003 (JP) ..... 2003-187699

(51) Int. Cl.
*B32B 5/26* (2006.01)

(52) U.S. Cl. ..... 442/240; 442/239; 442/243; 442/246; 442/247; 442/268; 442/270; 442/271; 442/324; 442/326; 442/381; 442/383

(58) Field of Classification Search ..... 442/239, 442/240, 243, 246, 247, 268, 270, 271, 324, 442/326, 381, 383
See application file for complete search history.

(56) References Cited

U.S. PATENT DOCUMENTS 4,119,753 A * 10/1978 Smart ..... 442/187
4,425,392 A * 1/1984 Oikawa et al. ..... 428/90
4,863,786 A * 9/1989 Green et al. ..... 442/241
4,940,630 A 7/1990 Penven
5,110,672 A 5/1992 Zehle et al.
5,840,635 A * 11/1998 Bertotto ..... 442/270

FOREIGN PATENT DOCUMENTS

| | | |
|---|---|---|
| EP | 0287229 A1 | 3/1988 |
| GB | 902503 A | 8/1962 |
| JP | 57-128290 | 8/1982 |
| JP | 57-176295 | 10/1982 |
| JP | 06-280183 | 10/1994 |
| WO | WO 02/053833 A1 | 7/2002 |

* cited by examiner

*Primary Examiner*—Andrew T. Piziali
(74) *Attorney, Agent, or Firm*—Wolf, Greenfield & Sacks, P.C.

(57) ABSTRACT

This invention relates to a papermaking felt which makes it possible to increase the proportion of the base body thereby preventing flattening without costing extra production man-hour, and to maintain the functions such as the water drainage, wet paper smoothening capability, and wet paper web transport capability throughout its entire use period. The papermaking felt is composed of a base body and a batt fiber layer, characterized in that one or more thicknesses of endless base bodies are disposed on the felt back-face side and one or more thicknesses of open-ended base bodies is annularly wound not less than one turn on the felt front-face side.

6 Claims, 5 Drawing Sheets

PAPERMAKING FELT

DETAILED DESCRIPTION OF THE INVENTION

1. Field of the Invention

The present invention relates to a felt for use in the press part of a papermaking machine, and particularly to a papermaking felt that performs a function of squeezing water from a wet paper sheet by being pressurized in the press section of the papermaking machine.

2. Prior Art

In a papermaking machine for removing water from the raw material of paper, dewatering is performed successively in three main parts: forming, press, and drying. And, in each part, different papermaking tools are being used corresponding to respective dewatering functions.

Conventionally, a papermaking felt is used in the press part, in which the felt and wet paper are passed through a press pressurizing section provided in the press part to move the water in the wet paper to the papermaking felt thereby removing water from the wet paper.

The press pressurizing section is commonly composed of a pair of press rolls or a press roll and a shoe having a shape adapted to the peripheral surface of the press roll.

The configuration of the papermaking felt will be described referring to FIG. 1. The papermaking felt 10 is configured by laminating a batt fiber layer 30 on a base body 20 and implanting fibers by needle punching etc.

For the base body 20, a woven fabric constructed by weaving the warp 21 and the weft 22 is commonly used.

The papermaking felt has basic functions such as squeezing water from the wet paper (water drainage), improving the smoothness of the wet paper (smoothening capability), and transporting the wet paper (wet paper web transport capability). And particularly, the function of squeezing water out of the wet paper is valued.

The function of squeezing water from the wet paper includes transferring water in the wet paper to the felt by applying pressure thereon while passing through between a pair of press rolls and then discharging the water in the felt from the felt back-face by applying pressure thereon or by sucking with a suction box of the papermaking machine. Therefore, particularly valued is the sustainability of the water permeability of the felt and its function of being readily compressed under pressure and recovering upon release of the pressure.

Recent trends in papermaking technology has been a speed-up of the papermaking machine and increased pressurizing pressure in the press part by use of rolls or a shoe press and the like for enhancing its productivity; these cause flattening of the papermaking felt in a high pressure resulting in a problem that the water permeability and compression recoverability of the felt decrease thereby significantly degrading the water drainage.

To solve such flattening of the papermaking felt, a method has been proposed in which the proportion of the base body portion is increased to prevent flattening of the felt.

One method to increase the proportion of the base body is to fabricate a papermaking felt by superposing a plurality of rolls of endless base fabric such as one fabricated by a hollow weave or other base fabric which is formed by joining the both ends of an open-ended base fabric into an endless form as shown in FIGS. 2 and 3, laminating batt fibers thereon, and thereafter intertwiningly integrating them with the base fabric by needle punching (see, for example, patent documents 1, 2).

In this case, to intertwiningly integrate multiple rolls of endless base bodies by needle punching, the dimensions of each endless base body need to be matched.

However, when combining base bodies, base bodies having different kinds of threads and weave structures are often used as a countermeasure against a press-marking on the wet paper; one such case is that a thinner thread is used for the base body 23 on the side of contacting the wet paper and a thicker thread is used for the base body 24 on the other side. This tends to cause the dimensional change after weaving to differ and therefore, as the number of base bodies increases, there would occur more dimensional mismatches when superposing them by needling, or wrinkling on the base body due to different dimensional changes during needling.

When there are dimensional mismatches among the base bodies, although there is a method to achieve a dimensional match by stretching them while needling, there existed a quality problem in that wrinkling occurred during needling, or a problem that the base bodies had to be disengaged to adjust its dimension by heat set when dimensional match was not achieved by stretching.

On the other hand, as shown in FIG. 4, there is a method to fabricate a papermaking felt by annularly winding and laminating the open-ended base fabric 26, which is woven in a simple structure, in a continuous manner, laminating batt fibers on one side or both sides of the foregoing base fabric structure, and thereafter intertwiningly integrating them with base fabric by needle punching (see, for example, patent document 3).

In this case, as shown in FIG. 5, the edges of the base body, i.e. the start-edge and the end-edge are superposed crossing a same line in the widthwise direction, and the weft 22 in the superposed portion of the joint portion 25 are removed to eliminate the step formed in the joint portion 25 for flattening purpose. However, if the batt fibers of the batt fiber layer 32 on the felt back-face side are worn out due to wear causing the edges of the base body to be exposed as the papermaking felt is kept being used, a problem will arise in that the edges of the base body are rolled up, or that when the tension on the felt in service is high, the joint portion is opened up and thus a step is produced causing a marking on the paper.

Therefore, one countermeasure for preventing the back-face wear is to increase the amount of the batt fiber layer 32 on the back-face side; however, increasing the amount of the batt fiber layer 32 on the back-face side resulted in a problem that the water permeability is decreased thereby impairing the water drainage.

Moreover, even in the case that a base body structure is produced by forming an endless base body of a single weave, then forming a base body structure by annularly winding a long open-ended base body to laminate along the inner side the endless base body, and needling fibrous webs on both faces of the base body structure, this would not be sufficient as the countermeasure against the back-face wear when the joint portion on the back-face side is exposed.

[Patent document 1] JP, A, 57-128290

[Patent document 2] JP, A, 57-176295

[Patent document 3] Japanese Patent No. 3045895

Problems to be solved by the Invention

Accordingly, the object of the present invention is to solve the above described problems and provide a papermaking felt which makes it possible to increase the proportion of the base part without spending production man-hours thereby preventing flattening of the felt, and to maintain its functions such as the water drainage, wet-paper smoothening capability, and wet paper web transport capability throughout its entire use period.

Means for Solving the Problem

The present inventors have eagerly conducted research to solve the above described problems and have found that by disposing an endless base body on the felt back-face side, and annularly winding an open-ended base body not less than one turn to laminate it on the felt front-face side, a papermaking felt may be achieved which makes it possible to increase the proportion of the base body thereby preventing flattening of the felt and to maintain its functions such as water drainage, wet-paper smoothening capability and wet paper web transport capability through the entire use period of the felt.

Thus, the present invention relates to a papermaking felt consisting of not less than two thicknesses of base bodies of a same or different kind and a batt fiber layer laminated on one side or both sides of the base bodies, characterized in that said papermaking felt comprises one or more thicknesses of endless base bodies on the felt back-face side and further comprises one or more thicknesses of open-ended base bodies which are annularly wound not less than one turn to be laminated on the outside of the endless base bodies.

The present invention further relates to the above described papermaking felt, characterized in that not less than two thicknesses of open-ended base bodies which are different in kind with one another are annularly wound not less than one turn to be laminated.

The present invention further relates to any of the above described papermaking felts, characterized in that the base body on the felt front-face side has a higher level of smoothness compared with the base body on the felt back-face side.

The present invention further relates to any of the above described papermaking felts, characterized in that the warp of the base body on the felt front-face side has a smaller diameter than the warp of the base body on the felt back-face side.

The present invention further relates to any of the above described papermaking felts, characterized in that the weft in the joint portion of the open-ended base body are removed.

The present invention further relates to any of the above described papermaking felts, characterized in that water soluble fiber is used for the weft of the open-ended base body on the front-face side so that only the warp are left while in service.

The papermaking felt of the present invention makes it possible to prevent the flattening of the felt by disposing one or more endless base bodies on the felt back-face side and annularly winding an open-ended base body not less than one turn to be laminated on the felt front-face side thereby increasing the proportion of the base body, and also makes it possible to prevent the problem of the edges of the open-ended base body being rolled up or opened up due to the back-face wear since there is no joint portion of the open-ended base body on the felt back-face side, there by maintaining the felt functions such as water drainage, wet-paper smoothening capability and wet paper web transport capability throughout the entire use period of the felt.

Furthermore, according to the present invention, it is possible to manufacture a papermaking needle felt in which the dimensional adjustment upon combining the base bodies is easy and there is no problem of wrinkling during needling.

EMBODIMENTS OF THE INVENTION

The embodiments of the papermaking felt of the present invention will be described, but those will not limit the present invention.

FIG. 6 is a perspective view of one embodiment of the papermaking felt of the present invention, and FIG. 7 is a cross sectional view in which dotted line portion is sectioned in MD direction. The papermaking felt 10 is configured such that an endless base body 24 is disposed on the back-face side of the felt and open-ended base bodies 26 are annularly wound in a continuous manner to be laminated on the front-face side of the felt, and the front-face side batt fiber layer 31 and the back-face side batt fiber layer 32 are laminated and thereafter intertwiningly integrated by needle punching.

The endless base body 24 commonly utilizes a fabric fabricated by weaving the warp 21 and the weft 22 with a weaving machine, and the warp 21 and the weft 22 utilize monofilament or multifilament of nylon, polyester, olefin, and others.

The endless base body 24 commonly utilizes a fabric woven of the warp 21 and the weft 22 by a weaving machine and may have single-, double-, or multi-weave structure; but it preferably has a multi-weave structure to increase the proportion of the base body portion. Moreover, other than fabric, a product which is adhesively formed with an adhesive etc. without weaving the warp and weft, non-woven fabric, film, and resin molded components may be used.

In the present invention, the endless base body represents not only the base body itself which is woven in an endless form by a hollow weaving or the like, but also ones which are formed into an endless form by joining the edges of an open-ended base body prior to needling.

The open-ended base body 26 commonly utilizes a fabric woven from the warp 21 and weft 22 with a weaving machine etc. and the warp 21 and the weft 22 utilizes monofilament or multifilament of nylon, polyester, olefin, and others. However, spun yarn and urethane fiber may be used to improve compression recoverability since the lengthwise strength can be covered by the endless base body. Also the warp 21 may utilize a thread with higher ductility compared with the warp of the endless base body to decrease the difference in the dimensional change compared with that of the endless base body 24 on the back-face side.

The open-ended base body 26 commonly utilizes a fabric woven of the warp 21 and the weft 22 with a weaving machine etc. and preferably that of a single-weave structure in terms of the easiness of rolling-in operation.

When annularly winding an open-ended base body 26 in a continuous manner to laminate it on the endless base body 24, the open-ended base fabric may be not less than one turn and the joint portion 25 of the open-ended base body 26 may be configured such that the start-edge and the end-edge are abutted on a line in the widthwise direction, or maybe superposed crossing a line in the widthwise direction so that an opening-up will not occur. When superposition is used, it is preferably is performed with the weft 22 at the edge part being removed as shown in FIG. 8 in view of the transfer of a marking to the wet paper.

As the method for improving the smoothness of the papermaking felt, there are methods of: utilizing fibers of a small diameter, increasing the thread density of the warp 21 or weft 22, and changing the kind of the thread or weave structure on the front-face of the felt. Further, as shown in FIG. 9, there is a method to improve the smoothness by using water soluble fibers or solvent soluble fibers and the like for the weft to solve them during a finishing process leaving the warp alone.

Further, as shown in FIG. 10, not less than two kinds of different open-ended base bodies 26, 27 may be combined and configured in such a way that a base body comprised of fibers of smaller diameters and having an improved smoothness is disposed on the front-face side and a base body composed of thicker fibers is disposed on the back-face side in consideration of the resistance to flattening.

In this case, superposing each joint portion will have bad effects such as marking, and therefore it is desirable to displace each joint portion.

Furthermore, as shown in FIG. 11, in the configuration in which not less than two kinds of different open-ended base bodies 26, 27 are combined, by utilizing water soluble fibers for each of the weft of the base body 26 on the front-face side and the warp of the base body 27, and resolving them during a finishing process, it is made possible to achieve a structure in which there is no cross-over between the warp and the weft thereby improving the smoothness of the base body.

To annularly wind the open-ended base body 26 in a continuous manner to laminate it on the endless base body 24, either the method of rounding in the open-ended base body prior to the lamination of the batt fiber layer 30 on the needling machine, or the method of annularly winding the open-ended base body 26 in a continuous manner and laminating it concurrently with the lamination of the batt fiber layer 30 on the needling machine.

The batt fiber layer 30 is constructed by forming synthetic fibers such as nylon fibers or the short fibers of natural fibers such as wool into a web form and laminating it.

Moreover, the batt fiber layer 30, which consists of the front-face side batt fiber layer 31 which is located on the wet paper side and the back-face side batt fiber layer 32 which is located on the side of the press roll or shoe of the papermaking machine, may be composed of only the front-face side batt fiber layer 31 under some circumstances.

EXAMPLES

Next, the present invention will be described more specifically referring to examples as well as comparative examples; however, the present invention will not be limited by these examples.

Example 1

For the endless base body 24, a fabric having a double weave structure composed of the warp and the weft of nylon monofilament of 0.4 mm diameter was used, and for the open-ended base body 26, a fabric having a single-weave structure composed of the warp of 0.33 mm nylon monofilament and the weft of 0.2 mm nylon monofilament was used.

After rolling in the open-ended base body 26 two turns on the outer face (felt front-face side) of the endless base body 24 on a needling machine, the batt fiber layer 30 is laminated on each side and intertwiningly integrated with the base bodies by needle punching.

Comparative Example

For the open-ended base body 26, a fabric having a single-weave structure consisting of a warp of 0.33 mm nylon monofilament and a weft of 0.2 mm nylon monofilament was used.

After annularly rolling in the open-ended base body 26 three turns on a needling machine, a batt fiber layer 30 is laminated to each face thereof and intertwiningly integrated with the base body by needle punching.

After preparing the above described papermaking felts, experiments were conducted by using the apparatus shown in FIG. 12. The experimental apparatus of FIG. 12 is an apparatus for repeatedly pressing the felt 10 while applying a constant tension thereon by use of a pair of press rolls P.

An endurance test of the felts was conducted using this apparatus.

The driving conditions of the experimental apparatus are: a press pressure of 100 kg/cm$^2$, a felt driving speed of 1000 m/min, and a felt tension of 3.5 Kg/cm. The experiment was conducted for 1000 hours continuously.

Evaluation was made on a marking of felt at the joint portion before experiment, during experiment, and after experiment.

The test results on the above described items are shown in Table 1.

TABLE 1

| | Marking | | |
|---|---|---|---|
| | Before Test | After 500 hours | After 1000 hours |
| Example 1 | Good | Good | Good |
| Comparative example 1 | Good | Fair | Poor |

Observation of the appearance of the joint portion during the experiment showed that there was no abnormal conditions such as opening-up and rolling-up in the example; however, in the comparative example, an opening-up occurred after 500 hours and, after 1000 hours, the batt fiber layer at the back-face side was worn out due to the back-face wear and the joint portion became exposed resulting in a rolling-up of an edge of the open-ended base body.

ADVANTAGES OF THE INVENTION

The papermaking felt of the present invention does not have the problem of the transfer of markings on the wet paper since there is no opening-up of the joint portion, nor rolling-up of the edges of the open-ended base body during use due to the back-face wear.

Further, the papermaking felt of present invention eliminates the need to increase the amount of batt of the back-face side batt layer 32 as the countermeasure against the back-face wear and thus makes it possible to cope with any type of felt design.

Further, the papermaking felt of the present invention makes it possible to cope with such places where the tension in the felt in use is so high that conventional products could not be applied because of the problem of opening-up of the base body or other reasons.

Furthermore, in terms of the productivity, the papermaking felt of the present invention has solved various problems such as the need of height adjustment before needling and wrinkling during needling, and can provide a higher degree of freedom than before in the combination of the base bodies to be used.

BRIEF DESCRIPTION OF THE DRAWINGS

FIG. 1 shows the configuration of a conventional papermaking felt.

FIG. 2 shows a conventional papermaking felt in which not less than two thicknesses of endless base bodies are superposed.

FIG. 3 is a sectional view to show the dotted portion of FIG. 2 taken in the CMD direction.

FIG. 4 shows a conventional papermaking felt which is laminated by continuously winding an open-ended base body.

FIG. 5 is a sectional view of the dotted portion of FIG. 4 taken along the MD direction.

FIG. 6 is a perspective view of the papermaking felt of the present invention.

FIG. 7 is a sectional view of the dotted portion of FIG. 6 taken along the MD direction.

FIG. 8 shows a papermaking felt in which the weft 22 at the edge of the base body are removed before superposition.

FIG. 9 shows the structure which utilizes water soluble fibers for the weft 22 to leave the warp alone on the surface of the base body while in use.

FIG. 10 shows the papermaking felt in which not less than two kinds of open-ended base bodies are combined.

FIG. 11 illustrates the method to improve the smoothness of the base body by using water soluble fibers for the weft of the open-ended base body 26 and the warp of the base body 27.

FIG. 12 shows an apparatus for pressing the felt 10 with the press roll P.

DESCRIPTION OF SYMBOLS

Figure 1:
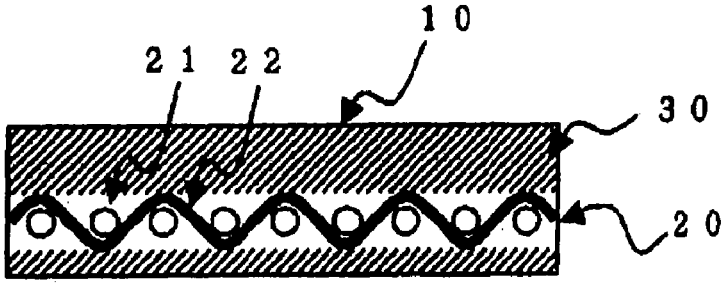
Fig. 1 (Prior Art)
FIG. 1
Figure 2:
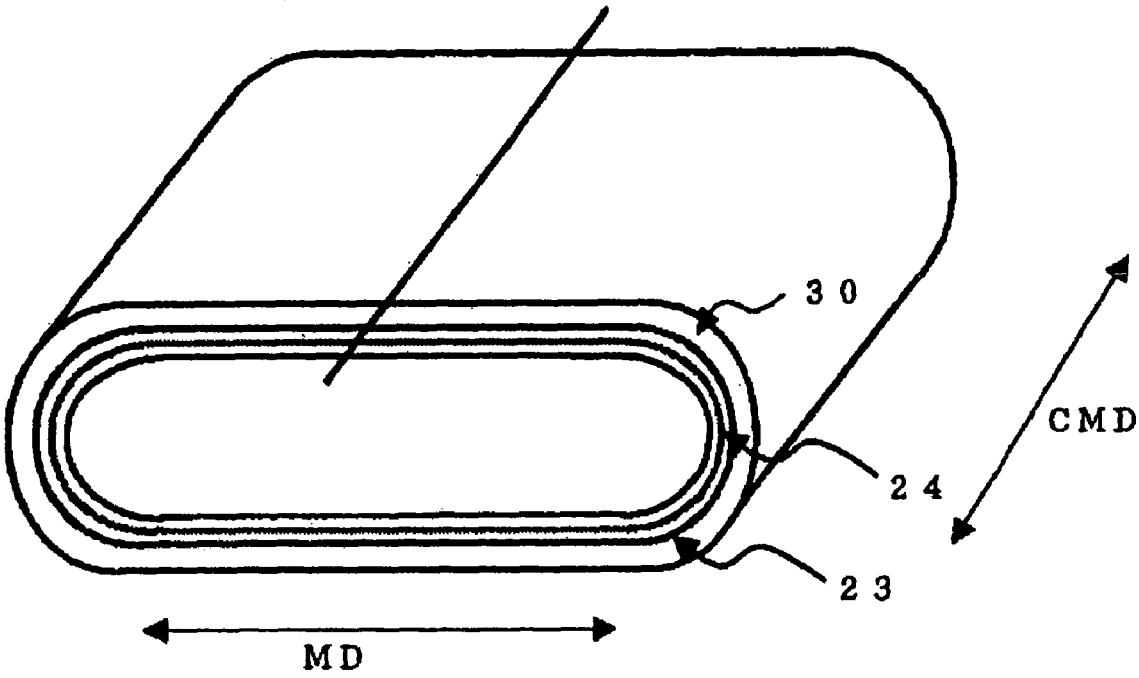
Fig. 2 (Prior Art)
FIG. 2
Figure 3:
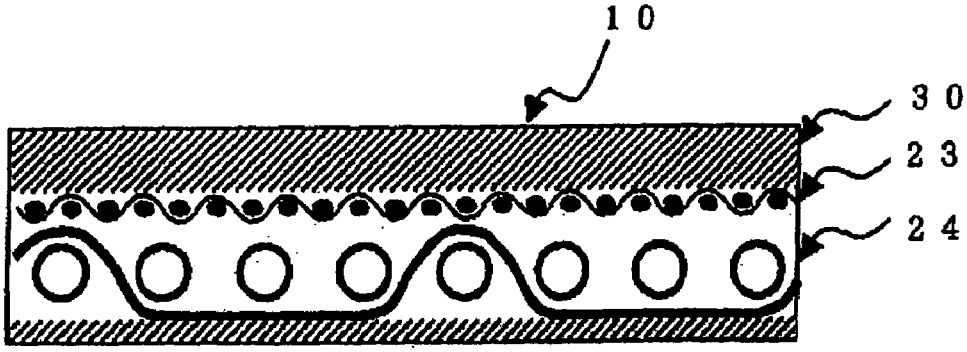
Fig. 3 (Prior Art)
FIG. 3
Figure 4:
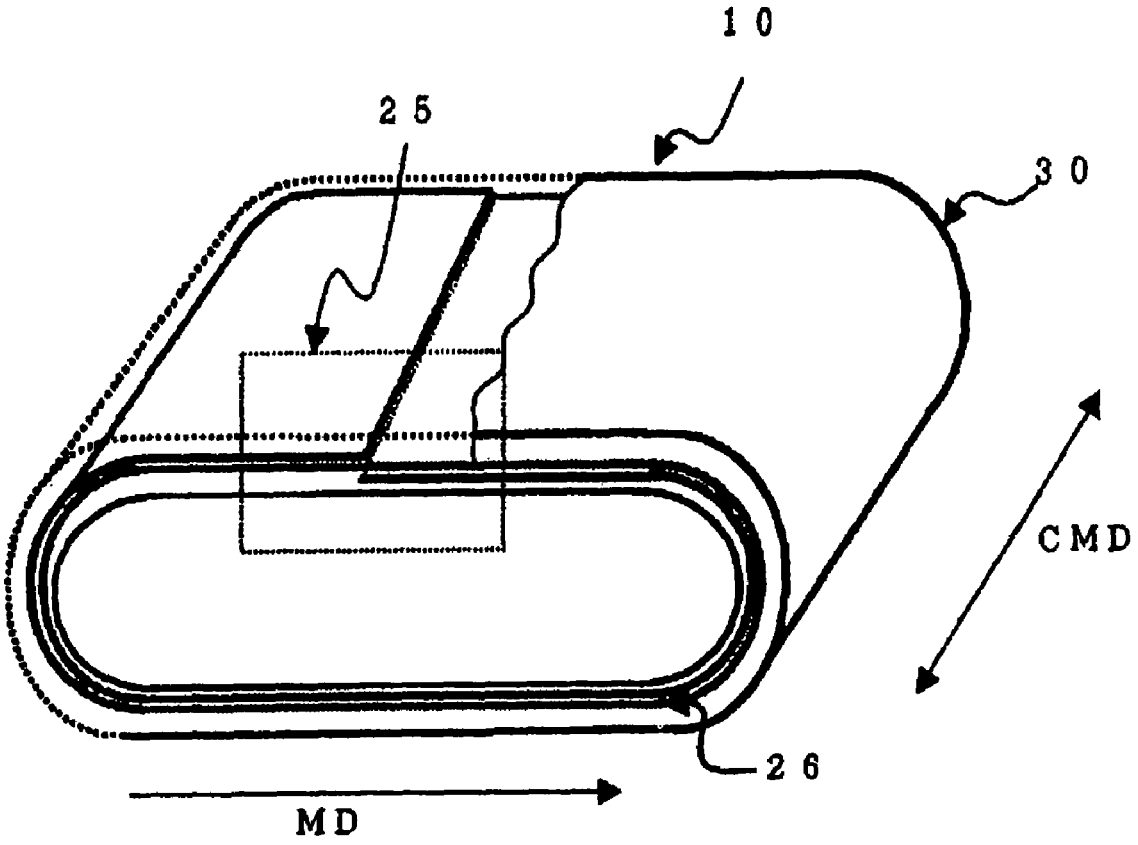
Fig. 4 (Prior Art)
FIG. 4
Figure 5:
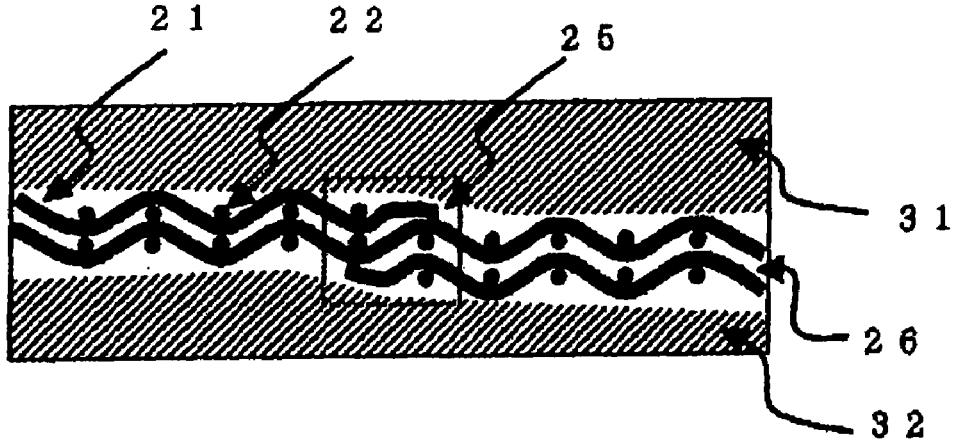
Fig. 5 (Prior Art)
FIG. 5
Figure 6:
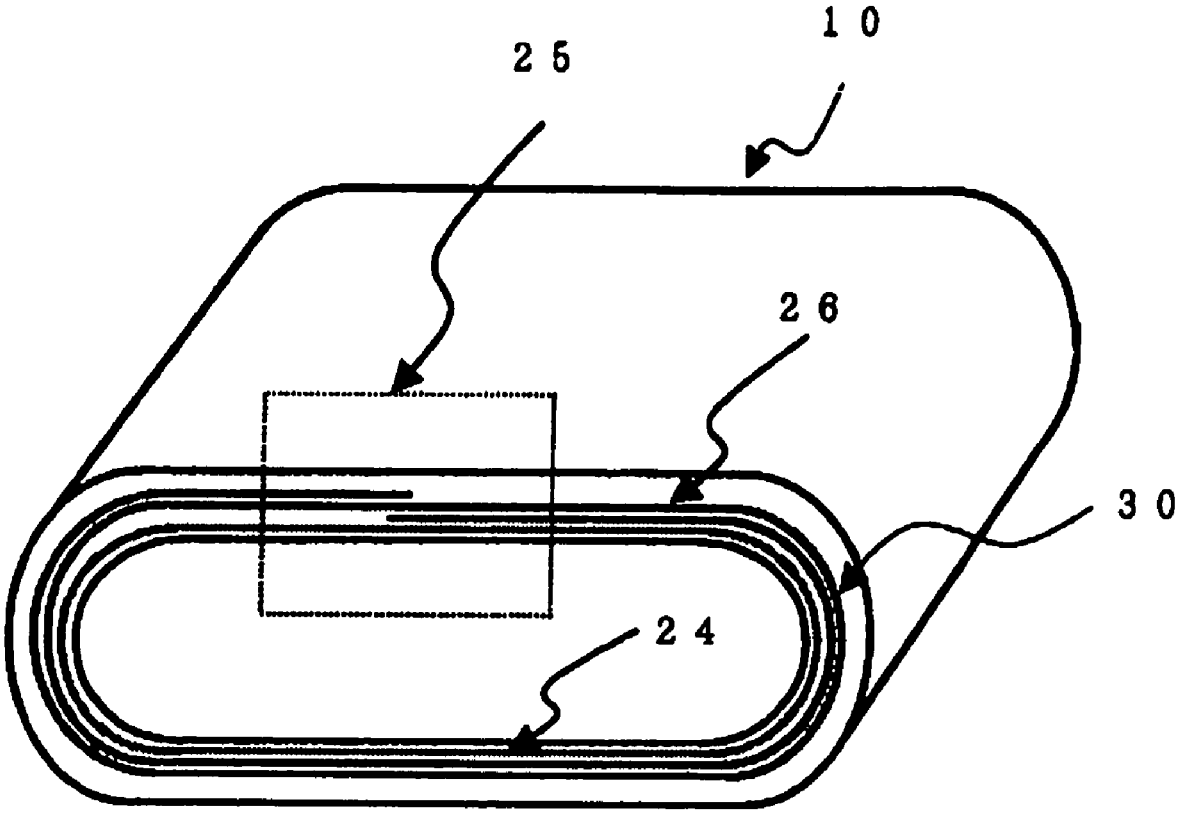
FIG. 6
Figure 7:
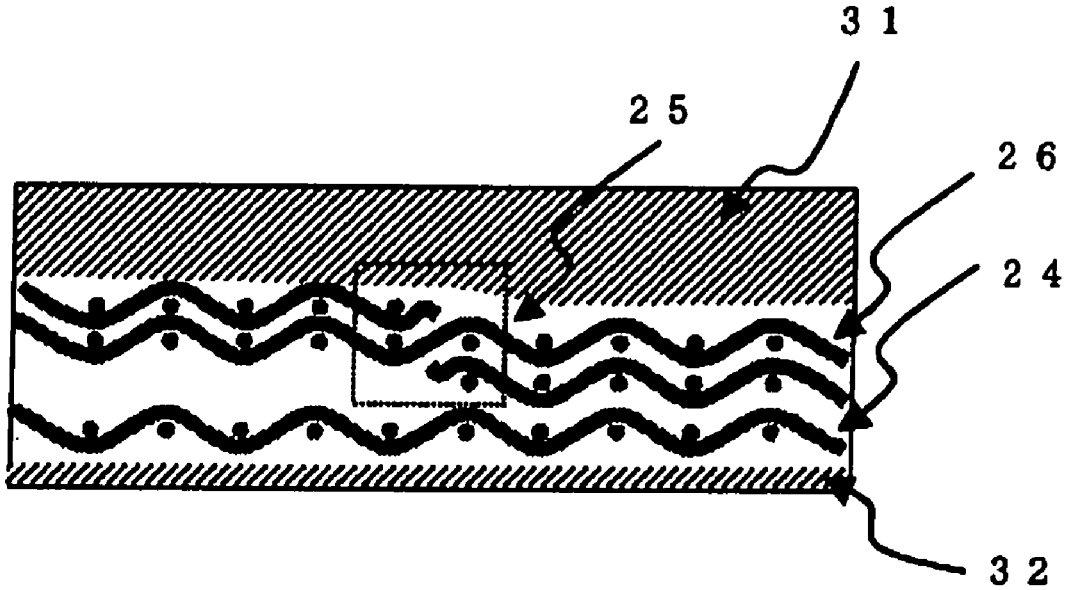
FIG. 7
Figure 8:
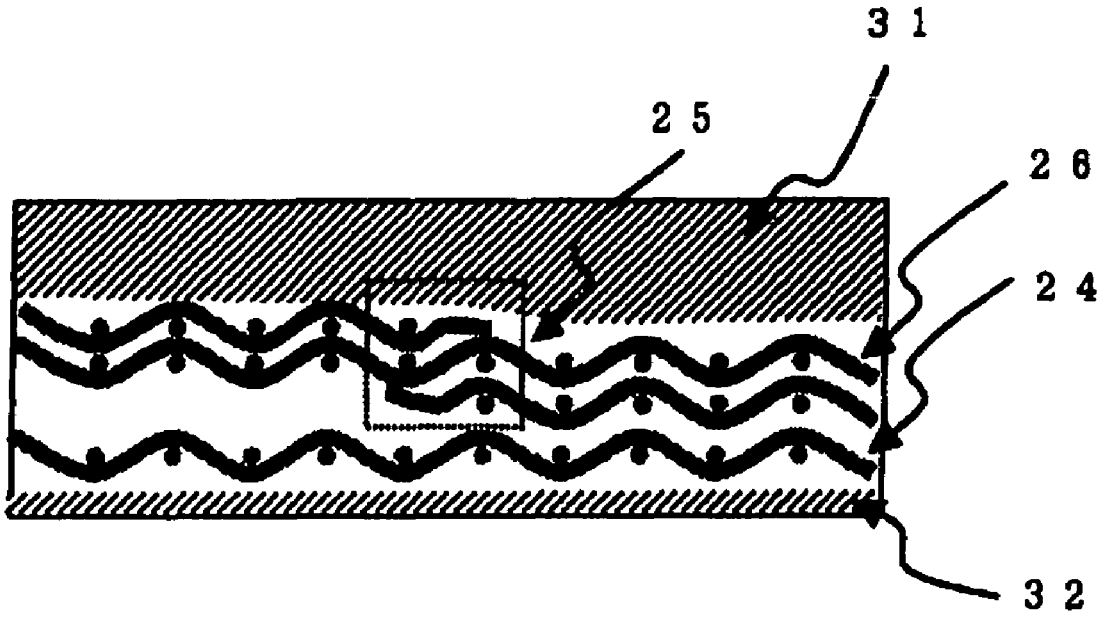
FIG. 8
Figure 9:
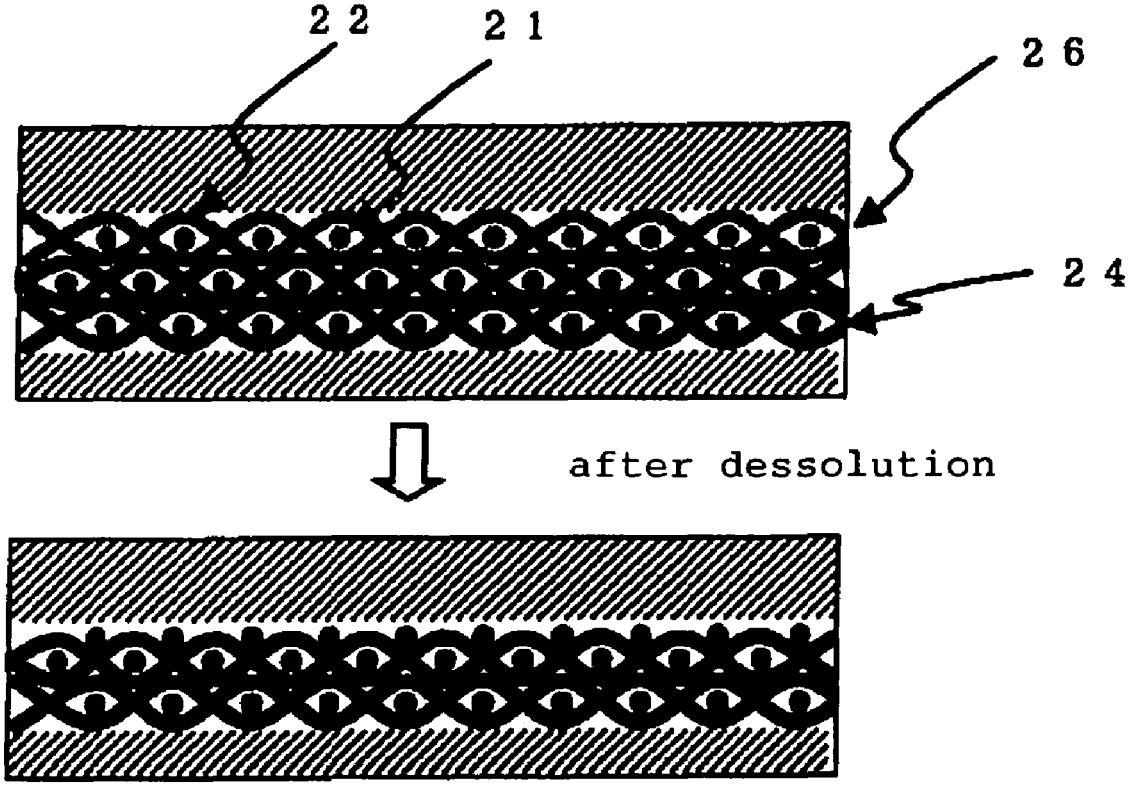
FIG. 9
Figure 10:
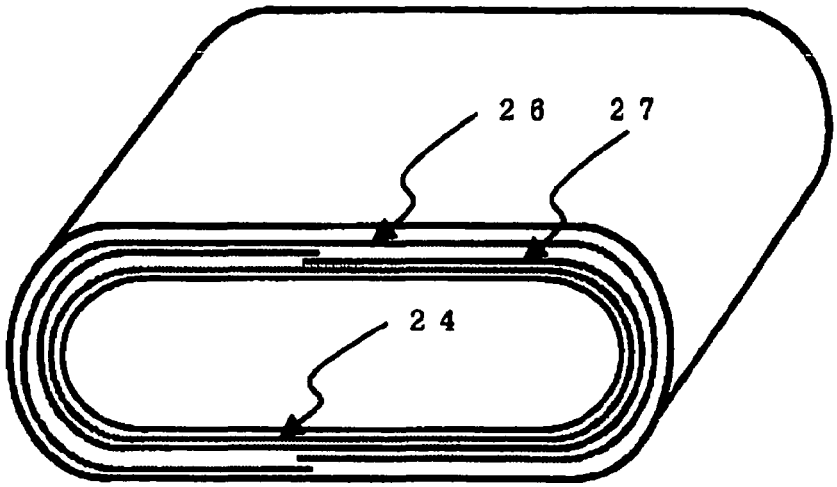
FIG. 10
Figure 11:
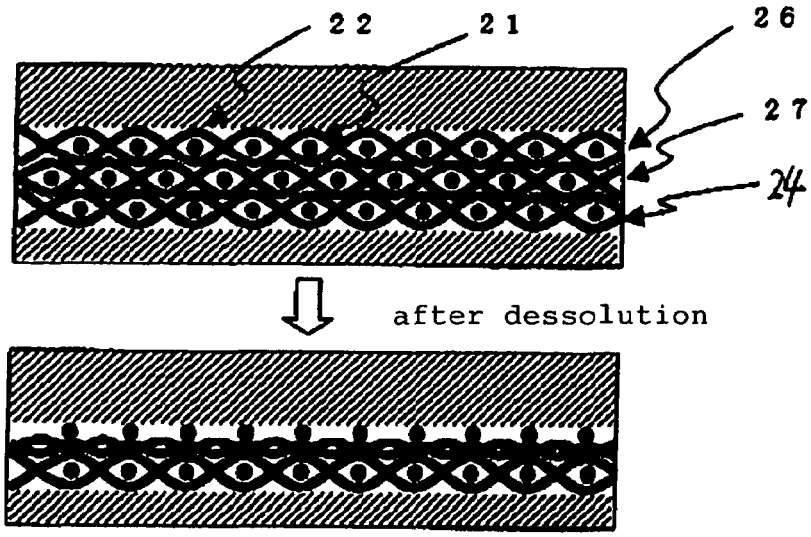
FIG. 11
Figure 12:
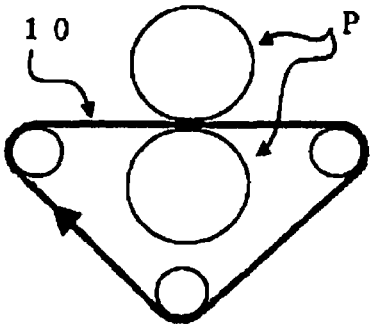
FIG. 12

10: Papermaking felt
20: Base body
21: Warp
22: Weft
23: Endless base body (felt front face side)
24: Endless base body (felt back face side)
25: Base body joint portion
26: Open-ended base body (felt front-face side)
27: Open-ended base body (felt bask-face side)
30: Batt fiber layer
31: Front-face side batt fiber layer
32: Back-face side batt fiber layer
P: Press pressurizing section

The invention claimed is:

1. A papermaking felt comprising not less than two thicknesses of base bodies of a same or different kind and a needled batt fiber layer characterized in that said base bodies comprise:

one or more thicknesses of endless base bodies, which are one of woven in an endless form by a hollow weaving or formed into an endless form by joining the edges of an open-ended base body prior to needling, on the felt back-face side and one or more thicknesses of open-ended base bodies, for easy dimensional adjustment upon combining the endless base bodies and the open-ended base bodies, the open-ended base bodies being annularly wound not less than one turn and laminated on the outside of the endless base bodies; and said batt fiber layer is laminated on one side or both sides of the base bodies;

wherein said base bodies comprise at least one of: a woven fabric, a product which is adhesively formed with an adhesive without weaving a warp and weft, a non-woven fabric, a film, or a resin molded component.

2. The papermaking felt according to claim 1, characterized in that not less than two thicknesses of open-ended base bodies which are different in kind with one another are annularly wound not less than one turn and laminated.

3. The papermaking felt according to claim 1, characterized in that the base body on the felt front-face side has a higher level of smoothness compared with the base body on the felt back-face side.

4. The papermaking felt according to claim 1, characterized in that the warp of the base body on the felt front-face side has a smaller diameter than the warp of the base body on the felt back-face side.

5. The papermaking felt according to claim 1, characterized in that the weft in the joint portion of the open-ended base body are removed.

6. The papermaking felt according to claim 1, characterized in that water soluble fiber is used for the weft of the open-ended base body on the felt front-face side so that only the warp are left while in service.

* * * * *